US010206493B2

(12) United States Patent
Wu et al.

(10) Patent No.: US 10,206,493 B2
(45) Date of Patent: Feb. 19, 2019

(54) ORAL CARE IMPLEMENT

(71) Applicant: COLGATE-PALMOLIVE COMPANY, New York, NY (US)

(72) Inventors: Donghui Wu, Bridgewater, NJ (US); Matthew Lee Kolb, Upper Black Eddy, PA (US); Paul Donald Carse, Milford, NJ (US)

(73) Assignee: Colgate-Palmolive Company, New York, NY (US)

( * ) Notice: Subject to any disclaimer, the term of this patent is extended or adjusted under 35 U.S.C. 154(b) by 164 days.

(21) Appl. No.: 15/309,256

(22) PCT Filed: May 8, 2014

(86) PCT No.: PCT/US2014/037272
§ 371 (c)(1),
(2) Date: Nov. 7, 2016

(87) PCT Pub. No.: WO2015/171148
PCT Pub. Date: Nov. 12, 2015

(65) Prior Publication Data

US 2017/0071326 A1 Mar. 16, 2017

(51) Int. Cl.
*A46B 11/00* (2006.01)
*A46B 5/00* (2006.01)
(Continued)

(52) U.S. Cl.
CPC ..... *A46B 11/0006* (2013.01); *A46B 5/0095* (2013.01); *A46B 5/021* (2013.01);
(Continued)

(58) Field of Classification Search
CPC ..... A46B 11/0006; A46B 11/0003; A46B 11/002; A46B 11/0041; A46B 11/0055;
(Continued)

(56) References Cited

U.S. PATENT DOCUMENTS 2,889,964 A 6/1959 Cooprider
3,316,923 A 1/1965 Wagner
(Continued)

FOREIGN PATENT DOCUMENTS

CN 2260503 Y 8/1997
CN 102824024 A 12/2012
(Continued)

OTHER PUBLICATIONS

International Search Report and the Written Opinion of the International Searching Authority issued in international application PCT/US2014/037272 dated Jan. 22, 2015.

*Primary Examiner* — David Walczak

(57) ABSTRACT

An oral care implement having a body having a handle, a head at an end of the handle, and at least one fluid outlet, the head having at least one oral care element extending therefrom; a reservoir in the body and for storing an oral care fluid; and a supply mechanism connected to the body, the supply mechanism having a user-operable selector comprising a cam, and an actuator comprising a follower in contact with the same, the actuator operable to cause the oral care fluid to flow from the reservoir towards the fluid outlet, and wherein the cam is movable relative to the body to cause movement of the follower relative to the body and thereby operate the actuator.

18 Claims, 3 Drawing Sheets

(51) Int. Cl.
*A46B 5/02* (2006.01)
*A46B 9/04* (2006.01)

(52) U.S. Cl.
CPC ..... *A46B 5/026* (2013.01); *A46B 9/04* (2013.01); *A46B 11/002* (2013.01); *A46B 11/0003* (2013.01); *A46B 11/0041* (2013.01); *A46B 11/0055* (2013.01); *A46B 11/0058* (2013.01); *A46B 2200/1066* (2013.01)

(58) Field of Classification Search
CPC ... A46B 11/0058; A46B 5/0095; A46B 5/021; A46B 5/026; A46B 9/04; A46B 2200/1066; A46B 11/0024; A46B 11/0017
See application file for complete search history.

(56) References Cited

U.S. PATENT DOCUMENTS

| | | | | | |
|---|---|---|---|---|---|
| 3,242,928 | A | | 3/1966 | Peters | |
| 3,592,551 | A | | 7/1971 | Muglia | |
| 3,606,555 | A | | 9/1971 | Ferro | |
| 3,612,706 | A | * | 10/1971 | Verga | A46B 11/02 401/190 |
| 3,640,470 | A | | 2/1972 | Susuki | |
| 3,724,726 | A | | 4/1973 | Susuki | |
| 3,937,235 | A | | 2/1976 | Broughton | |
| 4,692,047 | A | | 9/1987 | Endo | |
| 4,810,124 | A | | 3/1989 | Krueckel et al. | |
| 4,883,204 | A | | 11/1989 | Kay et al. | |
| 5,098,291 | A | * | 3/1992 | Curtis et al. | A61C 5/014 433/80 |
| 5,352,054 | A | | 10/1994 | Lhuisset | |
| 5,407,287 | A | | 4/1995 | Braun et al. | |
| 5,918,995 | A | | 7/1999 | Puurunen | |
| 6,056,470 | A | | 5/2000 | Nehashi et al. | |
| 6,406,207 | B1 | | 6/2002 | Wiegner et al. | |
| 8,398,325 | B2 | | 3/2013 | Wu et al. | |
| 2007/0041779 | A1 | | 2/2007 | Kuo | |
| 2011/0070016 | A1 | | 3/2011 | Richardson | |
| 2011/0116858 | A1 | | 5/2011 | Burrowes | |
| 2012/0301209 | A1 | | 11/2012 | Fattori | |

FOREIGN PATENT DOCUMENTS

| | | | |
|---|---|---|---|
| CN | 102824025 | A | 12/2012 |
| CN | 102860660 | A | 1/2013 |
| CN | 102907885 | A | 2/2013 |
| CN | 202941621 | U | 5/2013 |
| FR | 2726748 | | 5/1996 |
| FR | 2734695 | | 12/1996 |
| GB | 2351779 | | 1/2001 |
| WO | 1993/024030 | | 12/1993 |
| WO | 2003/082048 | | 10/2003 |
| WO | WO2007/049298 | | 5/2007 |

* cited by examiner

ORAL CARE IMPLEMENT

BACKGROUND

The present invention relates to an oral care implement, such as a toothbrush, having a supply mechanism for supplying an oral care fluid to a fluid outlet of the implement.

It is known to provide an oral care implement, such as a toothbrush, with a reservoir storing an oral care fluid that is feedable to a fluid outlet at a head of the implement. In some known such oral care implements, a thin diaphragm or membrane is provided at a thumb grip of a handle of the implement, which diaphragm is repeatedly deformable to cause pumping of the oral care fluid to the fluid outlet. However, the reliability over time of such known oral care implements depends upon the thin diaphragm remaining intact. Other known oral care implements have mechanisms including many moving parts for driving oral care fluid from a reservoir to a fluid outlet. However, such other known oral care implements are bulky, expensive to manufacture and assemble, and their reliability over time relies on the various components continuing to function and interact correctly.

There is a need for an oral care implement having a more robust supply mechanism for supplying an oral care fluid to a fluid outlet of the implement. There also is a need for an oral care implement having a simple and compact supply mechanism for supplying an oral care fluid to a fluid outlet of the implement.

BRIEF SUMMARY

An embodiment of the present invention provides an oral care implement, comprising: a body comprising a handle, a head at an end of the handle, and at least one fluid outlet, the head having at least one oral care element extending therefrom; a reservoir in the body and for storing an oral care fluid; and a supply mechanism connected to the body, the supply mechanism comprising: a user-operable selector comprising a cam, and an actuator comprising a follower in contact with the same, the actuator operable to cause the oral care fluid to flow from the reservoir towards the fluid outlet, and wherein the cam is movable relative to the body to cause movement of the follower relative to the body and thereby operate the actuator.

Optionally, the cam is a linear cam.

Optionally, each of the cam and the follower comprises a surface in contact with the other of the cam and the follower. Further optionally, one or each of the cam and the follower comprises a planar surface in contact with the other of the cam and the follower. Still further optionally, the cam comprises a planar first surface in contact with a planar second surface of the follower, and the first surface is parallel to the second surface.

Optionally, the selector comprises a user-contactable surface forming a portion of an exterior surface of the oral care implement. Optionally, the user-contactable surface is fixed relative to the cam. Optionally, the selector comprises a unitary component comprising the user-contactable surface and the cam.

Optionally, the selector defines a portion of a fluid passageway extending to the fluid output.

Optionally, the follower defines a portion of a fluid passageway extending to the fluid output.

Optionally, the cam is movable relative to the body along a first axis and the follower is movable relative to the body along a second axis that is at between 45 and 90 degrees to the first axis. Further optionally, the second axis is substantially perpendicular to the first axis.

Optionally, the follower is movable relative to the body along an axis substantially parallel to a longitudinal axis of the oral care implement.

Optionally, the supply mechanism comprises a first valve connected to the actuator, and the actuator is operable to cause movement of the first valve relative to the reservoir between a first position, at which the first valve isolates the reservoir from downstream of the valve, and a second position, at which the reservoir is in fluid communication with downstream of the first valve. Further optionally, the first valve comprises one of a check valve, a diaphragm check valve, a ball check valve, a swing check valve, a duckbill check valve, and a plunger valve.

Optionally, the supply mechanism comprises a biasing device that biases the supply mechanism to a state in which the first valve is at the first position.

Optionally, the reservoir is comprised in an aerosol can. The actuator may be connected to the first valve via a valve stem of the aerosol can, and the actuator may be operable to cause movement of the valve stem relative to the reservoir, thereby to cause movement of the first valve relative to the reservoir between the first position and the second position.

Optionally, the oral care fluid is stored in the reservoir with a propellant. Preferably, the propellant comprises a liquefied gas. Further preferably, the liquefied gas comprises one or more of propane, butane, isobutene, dimethyl ether, and a hydrofluorocarbon, or a mixture of any two or more thereof. The propellant may additionally or alternatively comprise a compressed gas. Optionally, the compressed gas comprises one or more of nitrogen, carbon dioxide, nitrous oxide, and compressed air, or a mixture of any two or more thereof.

Optionally, the supply mechanism comprises a pump for pumping the oral care fluid from the reservoir towards the fluid outlet, and the actuator is operable to cause the pump to pump the oral care fluid from the reservoir towards the fluid outlet.

Optionally, the pump comprises a first valve, a second valve downstream from the first valve, and a chamber between the first valve and the second valve. Further optionally, the first valve comprises one of a check valve, a diaphragm check valve, a ball check valve, a swing check valve, a duckbill check valve, and a plunger valve.

Optionally, the chamber is of variable volume.

Optionally, the oral care fluid is stored in the reservoir.

Optionally, the oral care fluid is stored in the reservoir at greater than atmospheric pressure.

Optionally, the reservoir is in the handle.

Optionally, the reservoir is comprised in the body and forms the handle.

Optionally, the reservoir is detachably connected to the body.

Optionally, the reservoir is transparent or translucent.

Optionally, the oral care fluid comprises one or more oral care agents selected from the group consisting of: antibacterial agents; oxidative or whitening agents; enamel strengthening or repair agents; tooth erosion preventing agents; tooth anti-sensitivity ingredients; gum health actives; nutritional ingredients; tartar control or anti-stain ingredients; enzymes; sensate ingredients; caries or plaque disclosing agents; flavors or flavor ingredients; breath freshening ingredients; oral malodor reducing agents; anti-attachment agents or sealants; diagnostic solutions; occluding agents, dry mouth relief ingredients; catalysts to enhance the activity of any of these agents; colorants or aesthetic ingredients; and combinations thereof.

Optionally, the oral care implement comprises a toothbrush.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

In the following description, each of the exemplary embodiments of the oral care implement of the invention comprises a manually-operated oral care implement, more specifically a manually-operated toothbrush. However, in variations to these embodiments, the oral care implement could instead comprise a powered oral care implement, such as a powered toothbrush, wherein one or more oral care elements provided to the head of the implement are drivable so as to be moved relative to the handle of the implement. In still further embodiments, the oral care implement could instead comprise other forms of oral care implement, such as a soft-tissue cleaner, a tooth polisher, an interdental brush, a tongue scraper, or another implement designed for oral care. It is to be understood that other embodiments may be utilised, and that structural and functional modifications may be made without departing from the scope of the present invention.

Figure 1:
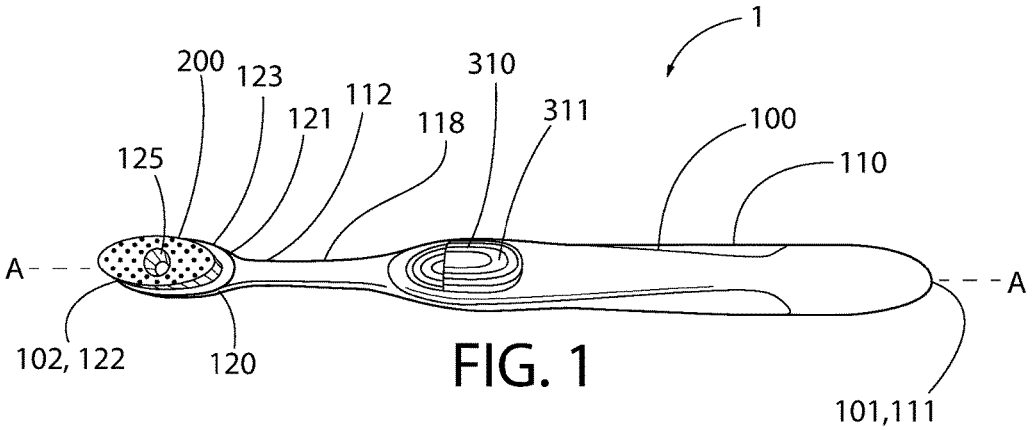
FIG. 1 shows a perspective view of an oral care implement according to an exemplary embodiment of the present invention.
Figure 2:
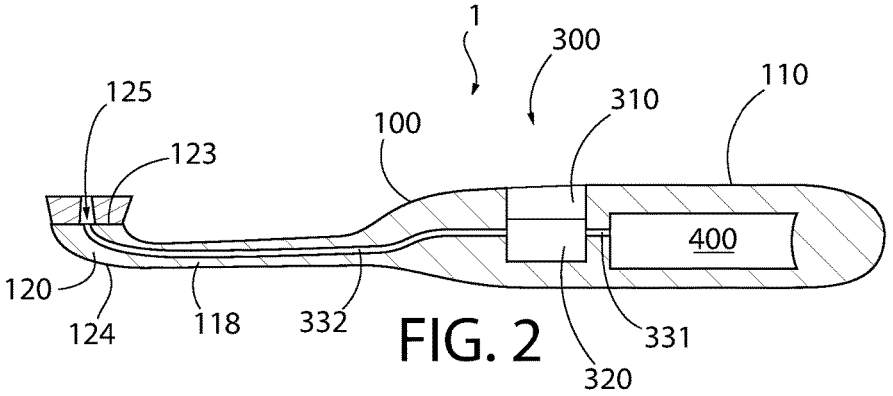
FIG. 2 shows a perspective cross-section view of the oral care implement of FIG. 1.
Figure 3:
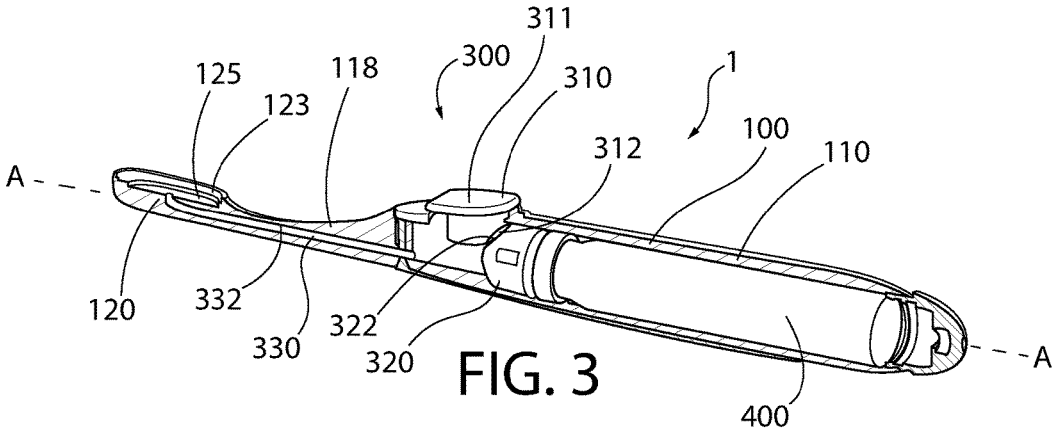
FIG. 3 shows a schematic diagram of the oral care implement of FIG. 1.

FIGS. 1 to 3 illustrate an oral care implement, in this case a toothbrush, according to an exemplary embodiment of the present invention, generally designated with the reference numeral 1. As viewed from the exterior, the toothbrush 1 generally comprises a body 100, oral care elements 200 and a fluid outlet 125 on a head 120 of the body 100, and a user-operable selector 310 of a supply mechanism 300 on a handle 110 of the body 100.

The body 100 of the toothbrush 1 has a proximal end 101 and a distal end 102 and is elongate between the proximal and distal ends 101, 102. The body 100 comprises the handle 110 and the head 120 at a distal end 112 of the handle 110. The head 120 is a distal portion of the body 100 and has a proximal end 121 and a distal end 122, which distal end 122 forms the distal end 102 of the body 100. The head 120 has extending therefrom the oral care elements 200 for cleaning or polishing surfaces in a user's mouth, such as surfaces of their teeth.

The oral care elements 200 extend from a first, front side of the toothbrush 1, more specifically from a first, front side 123 of the head 120, and are for cleaning or polishing surfaces in a user's mouth, such as surfaces of their teeth. As used herein, the term "oral care element" is used in a generic sense to refer to any structure that can be used to clean, massage or polish an oral surface, such as teeth or soft tissue, through relative surface contact. In this embodiment, the oral care elements comprise a plurality of tooth cleaning elements, preferably a plurality of flexible bristles arranged in tufts. However, in variations to this embodiment, the oral care elements may additionally or alternatively comprise one or more tooth polishing elements, preferably in the form of elastomeric tooth polishing elements, such as elastomeric protrusions, elements, fingers, or prophylactic (prophy) cups. In some embodiments, the oral care elements 200 may comprise at least one of any one or more of the following, without limitation: bristles, rigid bristles, flexible bristles, filament bristles, fibre bristles, nylon bristles, polybutylene terephthalate (PBT) bristles, tapered bristles, spiral bristles, rubber bristles, elastomeric protrusions, elastomeric elements, flexible polymer protrusions, co-extruded filaments, flag bristles, crimped bristles, anti-bacterial bristles and combinations thereof and/or structures containing such materials or combinations.

The head 120 also comprises the fluid outlet 125 at the first, front side 123 of the head 120. The fluid outlet 125 will be described in more detail below.

In a variation to the illustrated embodiment, a soft tissue cleaner may be provided on a second side of the toothbrush 1, such as a second, rear side of the toothbrush 1 opposite to the front side of the toothbrush 1. Such a soft tissue cleaner may be provided on a second, rear side 124 of the head 120.

The handle 110 is a proximal portion of the body 100 and has the distal end 112 and a proximal end 111, which proximal end 111 forms the proximal end 101 of the body 100. The handle 110 includes a neck portion 118 by which the handle 110 is connected with the head 120. The neck portion 118 is generally of a smaller cross sectional area than the rest of the handle 110. The neck portion 118 includes the distal end 112 of the handle 110, which is that portion of the handle 110 fixed to and closest to the proximal end 121 of the head 120. In the illustrated embodiment, the head 120 is non-detachable from the handle 110. However, in variations to the illustrated embodiment, the head 120 may be detachable from the handle 110, such as for replacement of the head 110 when the oral care elements 200 become worn.

The handle 110 provides a user with a mechanism by which he/she can readily grip and manipulate the toothbrush 1, includes ergonomic features which provide a high degree of control for the user while maintaining comfort, and may be formed of many different shapes and with a variety of constructions. Although the handle 110 is a non-linear structure in the illustrated embodiment, the invention is not so limited, and in certain embodiments the toothbrush 1 may have a simple linear handle 110.

As best shown in FIGS. 2 to 5, the toothbrush 1 comprises a reservoir 400 in the handle 110 of the body 100. In the illustrated embodiment, the reservoir 400 is comprised in an aerosol can, and an oral care fluid is stored in the reservoir 400 at greater than atmospheric pressure. By "atmospheric pressure", it is meant 101 kPa. In variations to the illustrated embodiment, the oral care implement 1 is provided without oral care fluid in the reservoir 400, yet the reservoir 400 is suitable for storing an oral care fluid. The aerosol can may be made of a metal, such as aluminum, or a plastic, such as a thermoplastic polymer, e.g. polyethylene terephthalate (PET) or polypropylene (PP). In the illustrated embodiment, the aerosol can is made of opaque aluminum, is housed inside the body 100 of the toothbrush 1, and is not visible from the exterior of the toothbrush 1. However, in variations to the illustrated embodiment, the reservoir 400 is made of transparent or translucent material and one or more windows are provided in the body 100, so that the reservoir 400 and its contents are visible from the exterior of the toothbrush 1. In further embodiments, the body 100 comprises the reservoir 400 and the reservoir 400 forms at least part of the handle 110. In some embodiments, the reservoir 400 is the handle 110. In some embodiments, the reservoir 400 is detachably connected to the body 100 and may be replaceable or disposable.

Preferably, the oral care fluid comprises one or more oral care agents. Any suitable oral care agent(s) can be used in the present invention. In the illustrated embodiment, the oral care fluid is a mouthwash comprising one or more antibacterial agents, flavors or flavor ingredients, and breath freshening ingredients. However, in variations to the illustrated embodiment, the oral care fluid comprises one or more oral care agents selected from the group consisting of: antibacterial agents; oxidative or whitening agents; enamel strengthening or repair agents; tooth erosion preventing agents; tooth anti-sensitivity ingredients; gum health actives; nutritional ingredients; tartar control or anti-stain ingredients; enzymes; sensate ingredients; caries or plaque disclosing agents; flavors or flavor ingredients; breath freshening ingredients; oral malodor reducing agents; anti-attachment agents or sealants; diagnostic solutions; occluding agents, dry mouth relief ingredients; catalysts to enhance the activity of any of these agents; colorants or aesthetic ingredients; and combinations thereof. In some embodiments, the oral care fluid comprises more than one of the oral care agents listed in the preceding sentence. The oral care fluid preferably is free of (i.e., is not) toothpaste. Preferably, the oral care fluid is intended to provide supplemental oral care benefits in addition to merely brushing one's teeth.

The oral care fluid is stored in the reservoir 400 with a propellant. Preferably, the propellant comprises a liquefied gas, such as a liquefied gas comprising one or more of propane, butane, isobutene, dimethyl ether, and a hydrofluorocarbon, or a mixture of any two or more thereof. However, in some embodiments, the propellant comprises a compressed gas, such as a compressed gas comprising one or more of nitrogen, carbon dioxide, nitrous oxide, and compressed air, or a mixture of any two or more thereof. The use of liquefied gas is preferred due to the ability of liquefied gases to produce consistent pressure during discharge of the contents of the reservoir 400. As will be understood by the person skilled in the art, preferably the propellant is a fluid that boils at a temperature lower than a temperature at which the oral care fluid boils. Preferably, the propellant is a fluid that boils at a temperature well below room temperature (e.g. 21° C.).

As best shown in FIGS. 2 to 5, the toothbrush 1 also comprises the supply mechanism 300. The supply mechanism 300 is connected to the body 100 and is for supplying the oral care fluid from the reservoir 400 in the handle 110 to the fluid outlet 125 of the head 120. The supply mechanism 300 comprises the user-operable selector 310 on the handle 110. The selector 310 comprises a unitary component in the form of a push button comprising a user-contactable surface 311 forming part of an exterior thumb grip surface of the handle 110 of the toothbrush 1 and a linear cam 312 that is movable relative to the body 100 along a first axis, which first axis is substantially perpendicular to a longitudinal axis of the toothbrush 1. The user-contactable surface 311 is fixed relative to the cam 312, and the whole selector 310 is movable relative to the body 100 along the first axis. The supply mechanism 300 also comprises an actuator 320 operable to cause the oral care fluid to flow from the reservoir 400 towards the fluid outlet 125. The actuator 320 comprises a follower 322 in contact with the cam 312. The cam 312 is movable relative to the body 100 to cause movement of the follower 322 relative to the body 100, thereby to operate the actuator 320, as will be described further below.

Figure 4:
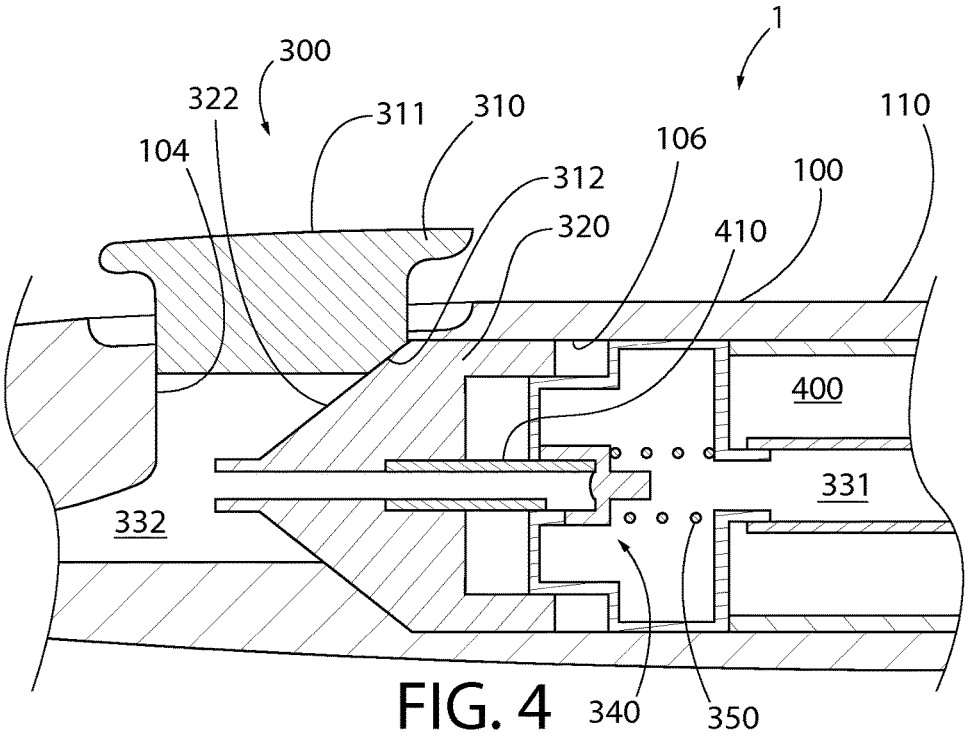
FIG. 4 shows a partial cross-section view of the oral care implement of FIG. 1, with a first valve of the implement at a first position relative to a reservoir of the implement.
Figure 5:
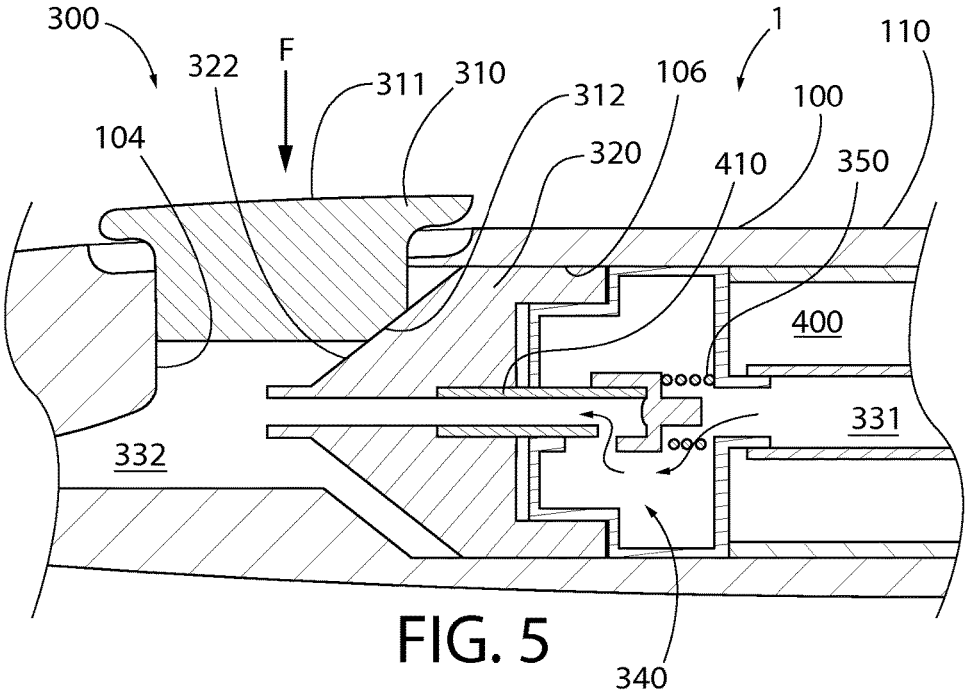
FIG. 5 shows a partial cross-section view of the oral care implement of FIG. 1 with the first valve at a second position relative to the reservoir.

As best shown in FIGS. 4 and 5, in the illustrated embodiment, the cam 312 comprises a planar first surface in contact with a planar second surface of the follower 322, and the first surface is parallel to the second surface. In variations to the illustrated embodiment, the planar first surface is non-parallel to the planar second surface. In some embodiments, one or each of the first and second surfaces may be non-planar, such as curved. In some embodiments, one of the cam 312 and the follower 322 may comprise an edge or a point in contact with a surface or an edge of the other of the cam 312 and the follower 322.

As discussed above, the cam 312 is movable relative to the body 100 along a first axis. The follower 322 is movable relative to the body 100 along a second axis that is substantially perpendicular to the first axis and substantially parallel to the longitudinal axis of the toothbrush 1. The body 100 includes a first guide 104 for restricting movement of the selector 310 and the cam 312 to movement along the first axis, and a second guide 106 for restricting movement of the actuator 320 and the follower 322 to movement along the second axis. In the illustrated embodiment, each of the first and second surfaces of the cam 312 and the follower 322 is at approximately 45 degrees to each of the first and second axes. In variations to the illustrated embodiment, the second axis may not be perpendicular to the first axis. However, preferably the second axis is at between 45 and 90 degrees to the first axis, and most preferably at between 75 and 90 degrees to the first axis.

The supply mechanism 300 further comprises a fluid passageway 330 extending between the reservoir 400 and the fluid outlet 125. A first portion 331 of the fluid passageway 330 extends from the reservoir 400 to a first plunger valve 340 (see FIG. 4) in the passageway 330, and comprises a dip tube in the reservoir 400. A second portion 332 of the fluid passageway 330 extends from the first valve 340 to the fluid outlet 125 in the head 120. As will be appreciated from consideration of FIGS. 4 and 5, each of the selector 310 and the actuator 320 defines a portion of the fluid passageway 330, and more specifically a portion of the second portion 332 of the fluid passageway 330. In the illustrated embodiment, a majority of the second portion 332 of the fluid passageway 330 is defined by material of the neck portion 118 of the body 100. In variations to the illustrated embodiment, some or a majority of the second portion 332 of the fluid passageway 330 may be defined by a separate tube that extends through the neck portion 118 of the body 100. In some embodiments, an end of such a separate tube defining some or a majority of the second portion 332 of the fluid passageway 330 may be connected directly to the downstream end of the actuator 320 so that the oral care fluid is carried directly from the actuator 320 into the separate tube.

The fluid outlet 125 may be of any form known in the art. The fluid outlet 125 may be in permanent fluid communication with the second portion 332 of the fluid passageway 330, or the fluid outlet 125 may comprise a valve, such as a check valve, that permits fluid flow from the second portion 332 of the fluid passageway 330 to the exterior of the toothbrush 1 and restricts or prevents fluid flow from the exterior of the toothbrush 1 to the second portion 332 of the fluid passageway 330. Optionally, the fluid outlet 125 includes a spray or atomizer nozzle for causing the oral care fluid to be emitted as one of a spray, a mist, and a stream. Such a nozzle optionally causes the oral care fluid to be emitted in the form of droplets having an average diameter of less than 500 microns, or less than 400 microns, or less than 300 microns, or less than 200 microns, or less than 150 microns.

The actuator 320 is connected to the first valve 340 via a valve stem 410 of the aerosol can. The actuator 320 is operable to cause movement of the valve stem 410 relative to the reservoir 400, thereby to cause movement of the first valve 340 relative to the reservoir 400 between a first position (see FIG. 4) and a second position (see FIG. 5). When the first valve 340 is at the first position relative to the reservoir 400, the first valve 340 isolates the reservoir 400 from downstream of the first valve 340, i.e. from the second portion 332 of the fluid passageway 330. When the first valve 340 is at the second position relative to the reservoir 400, the reservoir 400 is in fluid communication with downstream of the first valve 340, i.e. with the second portion 332 of the fluid passageway 330. The supply mechanism 300 comprises a biasing device, such as a coil spring, 350 connected between the aerosol can and the first valve 340 to bias the supply mechanism 300 to a state in which the first valve 340 is at the first position relative to the reservoir 400.

Operation of the illustrated toothbrush 1 will now be described. Preferably, a user applies a dentifrice to the oral care elements 200 and then uses the dentifrice and the oral care elements 200 to brush their teeth. In order to benefit from the effects of the oral care fluid in the reservoir 400, before, during or after brushing their teeth, while holding the head 120 in their oral cavity, the user applies a force F (see FIG. 4) onto the user-contactable surface 311 of the selector 310. The force F has at least a component in the direction of the first axis. Application of the force F causes the selector 310, including the cam 312, to be moved relative to the body 100 along the first axis, as guided by the first guide 104 of the body 100. Since the planar second surface of the follower 322 is in contact with the planar first surface of the cam 312, during this movement of the cam 312, the cam 312 causes movement of the follower 322 and the rest of the actuator 320 relative to the body 100 along the second axis, thereby to operate the actuator 320. This operation, or movement, of the actuator 320 relative to the body 100 causes movement of the valve stem 410 relative to the reservoir 400 and the body 100, thereby to cause movement of the first valve 340 to the second position relative to the reservoir 400 and the body 100. Once the first valve 340 is at the second position, the reservoir 400 is in fluid communication with the second portion 332 of the fluid passageway 330, and with the exterior of the toothbrush 1 via the fluid outlet 125, so the pressure on the propellant in the reservoir 400 is reduced. Accordingly, the propellant expands or begins to boil to create gas in the reservoir 400, which gas pushes the oral care fluid through the fluid passageway 330 and through the fluid outlet 125 to the exterior of the toothbrush 1 and into the user's oral cavity. When the user subsequently reduces or removes the force F, the biasing device 350 biases the first valve 340 to the first position relative to the reservoir 400, thereby to isolate the reservoir 400 from the second portion 332 of the fluid passageway 330 and the exterior of the toothbrush 1. By reapplying the force F, the user can repeat this process to supply more of the oral care fluid to the exterior of the toothbrush 1.

Given the limited number of moving parts of the supply mechanism 300, and given the compact nature of the components of the supply mechanism 300, the oral care implement 1 has a simple, robust and compact supply mechanism 300 for supplying the oral care fluid to the fluid outlet 125, and the implement 1 is reusable multiple times to apply the oral care fluid to an oral cavity.

In another exemplary embodiment, the supply mechanism comprises a pump for pumping the oral care fluid from the reservoir towards the fluid outlet, and the actuator is operable to cause the pump to pump the oral care fluid from the reservoir towards the fluid outlet. The pump may comprise a first valve, a second valve downstream from the first valve, and a chamber between the first valve and the second valve. Preferably, at least the first valve of the first and second valves is a check valve, such as any one of a diaphragm check valve, a ball check valve, a swing check valve, and a duckbill check valve. The chamber may be of variable volume. Part of an exemplary oral care implement comprising such a pump mechanism is shown in FIGS. 6 and 7.

Figure 6:
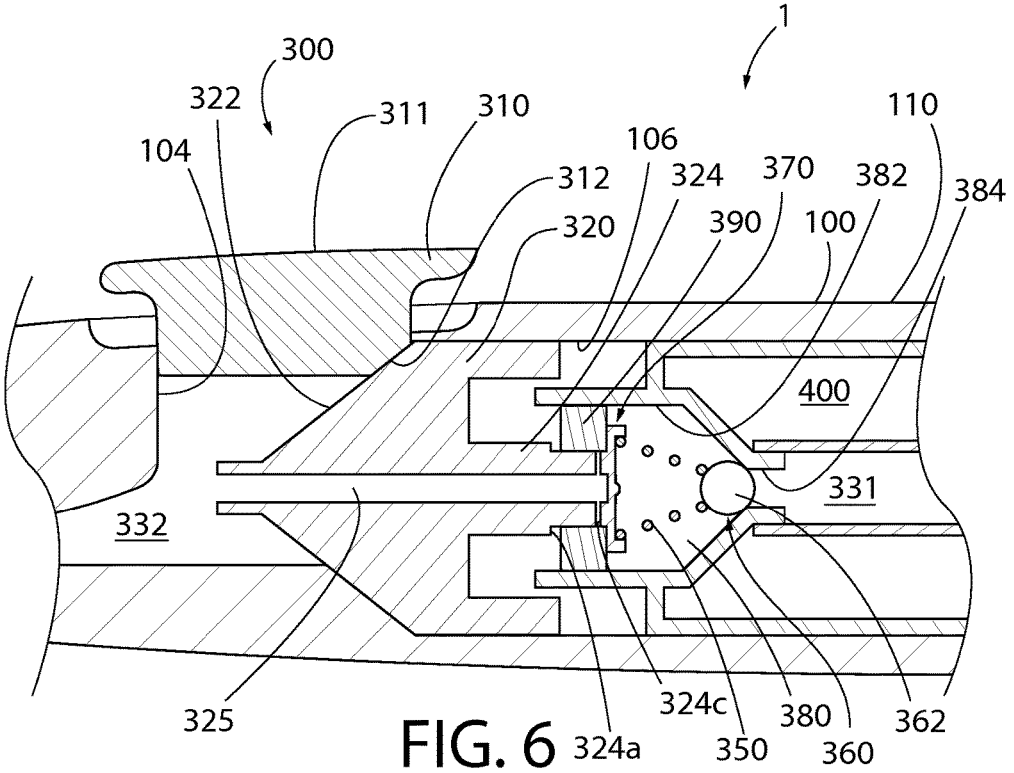
FIG. 6 shows a partial cross-section view of an oral care implement of another exemplary embodiment of the present invention, with a second valve of the implement at a first position relative to a reservoir of the implement.
Figure 7:
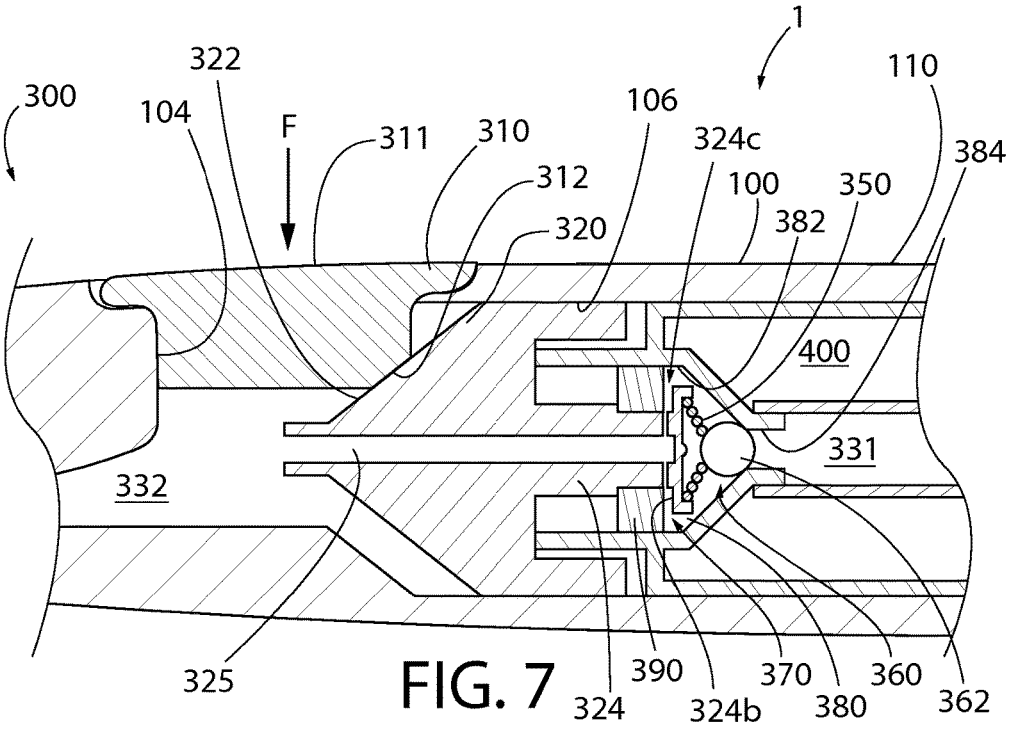
FIG. 7 shows a partial cross-section view of the oral care implement of FIG. 6, with the second valve at a second position relative to the reservoir.

In a variation to supply mechanism 300 of FIGS. 4 and 5, the oral care implement 1 of FIGS. 1 and 2 could instead have a supply mechanism 300 like that shown in FIGS. 6 and 7. Other than for the form of the supply mechanism 300, the oral care implement of which a part is shown in FIGS. 6 and 7 is the same as the oral care implement 1 of FIGS. 1 and 2. Like reference numerals used in FIGS. 6 and 7 and FIGS. 4 and 5 indicate like components.

The supply mechanism 300 of the implement 1 of FIGS. 6 and 7 comprises a pump comprising a first valve 360, in the form of a ball check valve, a second valve 370 downstream from the first valve 360 and in the form of a plunger valve, and a chamber 380 between the first and second valves 360, 370. The chamber 380 is of variable volume.

The actuator 320 comprises a stem 324 extending from the follower 322 and parallel to the longitudinal axis A-A of the implement 1. The stem 324 has a flow passage 325 therein extending parallel to the longitudinal axis A-A of the implement 1. A first end of the flow passage 325 is fluidly connected to the second portion 332 of the fluid passageway 330. A second end of the flow passage 325 distal from the follower 322 is closed. The stem 324 has one or more holes 324*c* extending radially outwardly from the flow passage 325 to an outer circumferential surface of the stem 324 adjacent the closed second end of the flow passage 325. On respective axial sides of the one or more holes 324*c*, the outer circumferential surface of the stem 324 has steps 324*a*,

324*b* therein, so that an outer diameter of the stem 324 between the steps 324*a*, 324*b* is less than respective outer diameters of the stem 324 further axially away from the one or more holes 324*c* than the steps 324*a*, 324*b*.

Slidably mounted on the outer circumferential surface of the stem 324 between the steps 324*a*, 324*b* the supply mechanism 300 comprises a piston 390. The piston 390 makes a seal on the outer circumferential surface of the stem 324, so that no fluid flow is possible from one side of the piston 390 to the other side of the piston 390. A radially inner side of the piston 390 is movable axially along the outer circumferential surface of the stem 324 between a first position, as shown in FIG. 6, at which the piston 390 blocks the one or more holes 324*c*, and a second position, as shown in FIG. 7, at which the one or more holes 324*c* are not blocked by the piston 390. The piston 390 thus has an axial length that is shorter than the distance along the outer circumferential surface of the stem 324 between the steps 324*a*, 324*b*. The piston 390 and the one or more holes 324*c* together form the second valve 370. A radially outer side of the piston 390 is movable axially along an inner surface 382 of the chamber 380 between a first position, as shown in FIG. 6, and a second position, as shown in FIG. 7. Preferably, a coefficient of friction between the piston 390 and the inner surface 382 of the chamber 380 is greater than a coefficient of friction between the piston 390 and the outer circumferential surface of the stem 324.

The chamber 380 includes an orifice 384 in fluid communication with the reservoir 400 via the first portion 331 of the fluid passageway 330. Within the chamber 380 is a ball bearing 362 that is movable relative to the orifice 384 between a first position at which the ball bearing 362 blocks the orifice 384 and a second position at which the orifice 384 is not blocked by the ball bearing 362. The ball bearing 362 and the orifice 384 form the first valve 360. A biasing device, such as a coil spring, 350 of the supply mechanism 300 biases the ball bearing 362 to the position at which the ball bearing 362 blocks the orifice 384. A first end of the biasing device 350 is connected to the ball bearing 362 and a second end of the biasing device 350 is connected to the stem 324. That is, the biasing device 350 is connected between the ball bearing 362 and the stem 324. The second end of the biasing device 350 may be fixed to the stem 324 or may just contact the stem 324. In a variation to the illustrated embodiment, the ball bearing 362 is not connected to the first end of the biasing device 350, but instead the ball bearing 362 is freely movable between its first and second positions due to the pressure differential between the reservoir 400 and the chamber 380. In such a variation, the first end of the biasing device 350 may sit on a ledge on the inner surface 382 without contacting the ball bearing 362, yet the second end of the biasing device 350 remains in contact with the stem 324 to bias the stem 342 axially away from the reservoir 400 relative to the chamber 380, as discussed below.

Operation of the toothbrush 1 of FIGS. 6 and 7 will now be described. Preferably, a user applies a dentifrice to the oral care elements 200 (not shown in FIGS. 6 and 7) and then uses the dentifrice and the oral care elements 200 to brush their teeth, as per the toothbrush 1 of FIGS. 1 to 5. In order to benefit from the effects of the oral care fluid in the reservoir 400, before, during or after brushing their teeth, while holding the head 120 in their oral cavity, the user applies a force F (see FIG. 4) onto the user-contactable surface 311 of the selector 310. The force F has at least a component in the direction of the first axis. Application of the force F causes the selector 310, including the cam 312, to be moved relative to the body 100 along the first axis, as guided by the first guide 104 of the body 100. Since the planar second surface of the follower 322 is in contact with the planar first surface of the cam 312, during this movement of the cam 312, the cam 312 causes movement of the follower 322 and the rest of the actuator 320 relative to the body 100 along the second axis, thereby to operate the actuator 320. This operation, or movement, of the actuator 320 relative to the body 100 (*a*) causes axial movement of the stem 324 towards the reservoir 400 and relative to the chamber 380 and the piston 390, so that the one or more holes 324*c* are unblocked by the piston 390 thereby to place the chamber 380 in fluid communication with the flow passage 325, and (b) causes the biasing force of the biasing device 350 on the ball bearing 362 to increase to maintain that the ball bearing 362 at the position at which the ball bearing 362 blocks the orifice 384. When the step 324*a* contacts the piston 390, continued axial movement of the stem 324 towards the reservoir 400 carries the piston 390 with the stem 324 relative to the chamber 380, in order to reduce the volume of the chamber 380, as shown in FIG. 7. This reduction in the volume of the chamber 380 causes any oral care fluid in the chamber 380 to be pushed from the chamber 380 into the flow passage 325 towards the second portion 332 of the fluid passageway 330. Thus, application of the force F causes opening of the second valve 370 while the first valve 360 is closed.

When the user subsequently reduces or removes the force F, the biasing device 350 biases the stem 324 axially away from the reservoir 400 relative to the chamber 380. The stem 324 initially moves relative to the piston 390 until the step 324*b* contacts the piston 390 so that the piston 390 blocks the one or more holes 324*c*, after which continued axial movement of the stem 324 away from the reservoir 400 carries the piston 390 with the stem 324 relative to the chamber 380, in order to increase the volume of the chamber 380. This increase in the volume of the chamber 380 causes a reduction in pressure in the chamber 380 relative to the pressure in the first portion 331 of the fluid passageway 330. Accordingly, the higher pressure in the first portion 331 of the fluid passageway 330 pushes the ball bearing 362 away from the orifice 384 against the biasing force of the biasing device 350, so that oral care fluid flows from the first portion 331 of the fluid passageway 330 and the reservoir 400 into the chamber 380. When the pressures in the chamber 380 and the first portion 331 of the fluid passageway 330 are substantially equal, the biasing device 350 acts to bias the ball bearing 362 to the position at which the ball bearing 362 blocks the orifice 384. Thus, removal of the force F causes closing of the second valve 370 and then temporary opening of the first valve 360.

By reapplying and re-removing the force F, the user can repeat this process to supply more of the oral care fluid from the chamber 380 to the second portion 332 of the fluid passageway 330, and then more of the oral care fluid from the reservoir 400 to the chamber 380. Overall, repeated application and removal of the force F causes a net movement of the oral care fluid from the reservoir 400 to the exterior of the toothbrush 1 via the first portion 331 of the fluid passageway 330, the chamber 380, the flow passage 325, the second portion 332 of the fluid passageway 330, and the fluid outlet 125, in that order.

In the illustrated embodiments, the cam 312 is a linear cam 312. This means that the cam 312 is movable in a substantially straight line relative to the body 100. In variations to the illustrated embodiment, the cam is a rotatable cam that is rotatable relative to the body 100. In such variations, the follower 312 still would be in contact with the cam.

In variations to the illustrated embodiments, the reservoir 400 may be provided elsewhere in the body 100 than at the position shown in the Figures. For example, the reservoir 400 may be provided in or adjacent to the neck portion 118 of the handle 110, or in the head 120 of the body 100. In some variations to the illustrated embodiment, the reservoir 400 may extend into both the handle 110 and the head 120 of the body 100.

What is claimed is:

1. An oral care implement, comprising:

a body comprising a handle, a head at an end of the handle, and at least one fluid outlet, the head having at least one oral care element extending from a front side of the body;

a reservoir in the body storing an oral care fluid; and a supply mechanism connected to the body, the supply mechanism comprising:

a user-operable selector comprising a cam on the front side of the body; and an actuator comprising a flow passage and a follower, the follower in contact with the cam, the actuator operable to cause the oral care fluid to flow from the reservoir towards the fluid outlet through the flow passage;

wherein the cam comprises a planar first surface in contact with a planar second surface of the follower, the first surface being parallel to the second surface;

wherein the cam is movable relative to the body to cause movement of the follower relative to the body and thereby operate the actuator; and wherein the planar second surface of the follower is located between the front side of the body and the flow passage of the actuator.

2. The oral care implement of claim 1, wherein the cam is a linear cam.

3. The oral care implement of claim 1, wherein each of the cam and the follower comprises a surface in contact with the other of the cam and the follower.

4. The oral care implement of claim 1, wherein the selector comprises a user-contactable surface forming a portion of an exterior surface of the oral care implement, and wherein the user-contactable surface is fixed relative to the cam, wherein the selector comprises a unitary component comprising the user-contactable surface and the cam.

5. The oral care implement of claim 1, wherein the selector defines a portion of a fluid passageway extending to the fluid outlet.

6. The oral care implement of claim 1, wherein the follower defines a portion of a fluid passageway extending to the fluid outlet.

7. The oral care implement of claim 1, wherein the cam is movable relative to the body along a first axis and the follower is movable relative to the body along a second axis that is substantially perpendicular to the first axis.

8. The oral care implement of claim 1, wherein the follower is movable relative to the body along an axis substantially parallel to a longitudinal axis of the oral care implement.

9. The oral care implement of claim 1, wherein the supply mechanism comprises a first valve connected to the actuator, and the actuator is operable to cause movement of the first valve relative to the reservoir between a first position, at which the first valve isolates the reservoir from downstream of the valve, and a second position, at which the reservoir is in fluid communication with downstream of the first valve.

10. The oral care implement of claim 9, wherein the supply mechanism comprises a biasing device that biases the supply mechanism to a state in which the first valve is at the first position.

11. The oral care implement of claim 9, wherein the reservoir is comprised in an aerosol can, the actuator is connected to the first valve via a valve stem of the aerosol can, and the actuator is operable to cause movement of the valve stem relative to the reservoir, thereby to cause movement of the first valve relative to the reservoir between the first position and the second position.

12. The oral care implement of claim 1, wherein the oral care fluid is stored in the reservoir with a propellant comprising at least one of a liquefied gas and a compressed gas.

13. The oral care implement of claim 1, wherein the supply mechanism comprises a pump for pumping the oral care fluid from the reservoir towards the fluid outlet, and wherein the actuator is operable to cause the pump to pump the oral care fluid from the reservoir towards the fluid outlet, wherein the pump comprises a first valve, a second valve downstream from the first valve, and a chamber between the first valve and the second valve.

14. The oral care implement of claim 13, wherein the chamber is of variable volume.

15. The oral care implement of claim 1, wherein the oral care fluid is stored in the reservoir at greater than atmospheric pressure.

16. The oral care implement of claim 1, wherein the reservoir is in the handle.

17. The oral care implement of claim 1, wherein the reservoir is detachably connected to the body.

18. The oral care implement of claim 1, wherein the oral care implement comprises a toothbrush.

* * * * *